US012330262B2

(12) United States Patent
Zuniga et al.

(10) Patent No.: US 12,330,262 B2
(45) Date of Patent: Jun. 17, 2025

(54) DUAL MEMBRANE CARRIER HEAD FOR CHEMICAL MECHANICAL POLISHING

(71) Applicant: Applied Materials, Inc., Santa Clara, CA (US)

(72) Inventors: Steven M. Zuniga, Soquel, CA (US); Jay Gurusamy, Santa Clara, CA (US); Andrew J. Nagengast, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 18/492,025

(22) Filed: Oct. 23, 2023

(65) Prior Publication Data

US 2024/0042574 A1 Feb. 8, 2024

Related U.S. Application Data

(62) Division of application No. 16/711,369, filed on Dec. 11, 2019, now Pat. No. 11,945,073.

(Continued)

(51) Int. Cl.

| | |
|---|---|
| ***B24B 37/32*** | (2012.01) |
| ***B24B 37/005*** | (2012.01) |
| ***B24B 49/16*** | (2006.01) |

(52) U.S. Cl.

CPC ..... *B24B 37/32* (2013.01); *B24B 37/005* (2013.01)

(58) Field of Classification Search

CPC ..... H01L 21/304; B24B 49/16

(Continued)

(56) References Cited

U.S. PATENT DOCUMENTS

| | | | |
|---|---|---|---|
| 6,080,050 | A | 6/2000 | Chen et al. |
| 6,422,927 | B1 | 7/2002 | Zuniga |

(Continued)

FOREIGN PATENT DOCUMENTS

| | | |
|---|---|---|
| CN | 102227803 | 10/2011 |
| CN | 108604543 | 9/2018 |

(Continued)

OTHER PUBLICATIONS

International Search Report and Written Opinion in International Appln. No. PCT/US2020/047256, dated Nov. 30, 2020, 12 pages.

(Continued)

*Primary Examiner* — Eileen P Morgan
(74) *Attorney, Agent, or Firm* — Fish & Richardson P.C.

(57) ABSTRACT

A carrier head for chemical mechanical polishing includes a base assembly and a membrane assembly connected to the base assembly. The membrane assembly includes a membrane support, an inner membrane secured to the membrane support, wherein the inner membrane forms a plurality of individually pressurizable inner chambers between an upper surface of the membrane and the membrane support, and an outer membrane secured to the membrane support and extending below the inner membrane, the outer membrane having an inner surface and an outer surface, wherein the outer membrane defines a lower pressurizable chamber between the inner surface of the outer membrane and a lower surface of the inner membrane, wherein the inner surface is positioned for contact by a lower surface of the inner membrane upon pressurization of one or more of the plurality of chambers, and wherein the outer surface is configured to contact a substrate.

6 Claims, 7 Drawing Sheets

Related U.S. Application Data

(60) Provisional application No. 62/890,570, filed on Aug. 22, 2019.

(58) Field of Classification Search
USPC ..... 451/288, 398
See application file for complete search history.

(56) References Cited

U.S. PATENT DOCUMENTS

| | | | | |
|---|---|---|---|---|
| 6,447,379 | B1 | 9/2002 | Gromko et al. | |
| 6,494,774 | B1 | 12/2002 | Zuniga et al. | |
| 6,506,104 | B2 | 1/2003 | Perlov et al. | |
| 6,623,343 | B2 | 9/2003 | Kajiwara et al. | |
| 6,648,740 | B2 | 11/2003 | Perlov et al. | |
| 6,659,850 | B2 | 12/2003 | Korovin et al. | |
| 7,988,537 | B2 * | 8/2011 | Togawa | B24B 37/32 451/388 |
| 11,511,389 | B2 | 11/2022 | Akazawa et al. | |
| 11,958,163 | B2 | 4/2024 | Nabeya et al. | |
| 2002/0039879 | A1 * | 4/2002 | Zuniga | B24B 37/30 451/288 |
| 2002/0061720 | A1 * | 5/2002 | Zuniga | B24B 37/30 451/288 |
| 2005/0211377 | A1 | 9/2005 | Chen et al. | |
| 2007/0082589 | A1 * | 4/2007 | Zuniga | B24B 37/30 451/288 |
| 2007/0207709 | A1 | 9/2007 | Berkstresser et al. | |
| 2007/0289124 | A1 * | 12/2007 | Oh | B24B 37/30 29/729 |
| 2008/0119120 | A1 | 5/2008 | Zuniga et al. | |
| 2012/0058709 | A1 * | 3/2012 | Fukushima | B24B 37/10 451/364 |
| 2016/0129547 | A1 | 5/2016 | Duescher et al. | |
| 2021/0053182 | A1 * | 2/2021 | Zuniga | B24B 37/32 |
| 2021/0053183 | A1 | 2/2021 | Zuniga et al. | |
| 2022/0281064 | A1 * | 9/2022 | Zuniga | B24B 37/30 |
| 2023/0241744 | A1 * | 8/2023 | Zuniga | B24B 37/30 451/5 |

FOREIGN PATENT DOCUMENTS

| | | |
|---|---|---|
| JP | 2001-060572 | 3/2001 |
| JP | 2001-079754 | 3/2001 |
| JP | 2005-520357 | 7/2005 |
| JP | 2008-131049 | 6/2008 |
| KR | 10-2008-0046598 | 5/2008 |
| KR | 10-2008-0100841 | 11/2008 |
| KR | 10-2018-0046877 | 5/2018 |
| KR | 10-2020-0033731 | 3/2020 |

OTHER PUBLICATIONS

Office Action in Japanese Appln. No. 2022-510788, dated Jan. 9, 2024, 7 pages (with English translation).

Office Action in Chinese Appln. No. 202010854945.5, dated Apr. 28, 2024, 15 pages (with English translation).

Notice of Third-Party Submission of Relevant Art in Korean Appln. No. 10-2022-7008939, dated Oct. 8, 2024, 3 pages (with partial English translation).

* cited by examiner

DUAL MEMBRANE CARRIER HEAD FOR CHEMICAL MECHANICAL POLISHING

CROSS-REFERENCE TO RELATED APPLICATIONS

This application is a divisional of U.S. application Ser. No. 16/711,369, filed on Dec. 11, 2019, which claims priority to U.S. Application Ser. No. 62/890,570, filed on Aug. 22, 2019, the disclosure of which is incorporated by reference.

TECHNICAL FIELD

This invention relates to a carrier head for use in chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a carrier head for chemical mechanical polishing includes a base assembly and a membrane assembly connected to the base assembly. The membrane assembly includes a membrane support, an inner membrane secured to the membrane support, and an outer membrane secured to the membrane support and extending below the inner membrane, the outer membrane having an inner surface and an outer surface. The inner membrane forms a plurality of individually pressurizable inner chambers between an upper surface of the membrane and the membrane support. The outer membrane defines a lower pressurizable chamber between the inner surface of the outer membrane and a lower surface of the inner membrane. The inner surface is positioned for contact by a lower surface of the inner membrane upon pressurization of one or more of the plurality of chambers, and the outer surface is configured to contact a substrate.

In another aspect, a system for chemical mechanical polishing includes a plurality of pressure sources, a carrier head, and a controller connected to the pressure sources. The carrier head includes a base assembly, and a membrane assembly. The membrane assembly has a membrane support, an inner membrane secured to the membrane support, and an outer membrane secured to the membrane support and extending below the inner membrane. The inner membrane forms a plurality of individually pressurizable inner chambers between an upper surface of the inner membrane and the membrane support. The outer membrane has an inner surface and an outer surface. The outer membrane defines a lower pressurizable chamber between the inner surface of the outer membrane and a lower surface of the inner membrane. The inner surface is positioned to contact a lower surface of the inner membrane upon pressurization of one or more of the plurality of chambers, and the outer surface is configured to contact a substrate. The controller is configured to cause the pressure sources to pressurize the inner chambers and the lower chamber such that one or more of the individually pressurizable inner chambers of the inner membrane are pressurized to a pressure equal to or greater than the pressure of the lower chamber to supplement the pressure applied by the outer membrane to the substrate at a portion of the outer membrane corresponding to the one or more individually pressurizable inner chambers.

In another aspect, a method for chemical mechanical polishing with a carrier head includes holding a substrate in a carrier head that includes a membrane assembly with an outer membrane and an inner membrane that defines a plurality of individually pressurizable inner chambers, pressurizing a lower chamber between the inner membrane and the outer membrane to a first pressure, pressurizing at least some of the plurality of individually pressurizable inner chambers to a second pressure equal to or greater than the first pressure, and creating relative motion between the substrate and a polishing pad such that pressure from the lower chamber causes polishing of the substrate at a first rate and pressure of the one or more inner chambers supplementally increases the polishing of the substrate in regions corresponding to the individually pressurizable inner chambers.

In another aspect, a membrane for a carrier head includes a plurality of chamber-defining portions, each chamber-defining portion including two side walls, a floor at the bottom edge of and connected the two side walls, and two flange portions extending inwardly from the two side walls. The adjacent chamber-defining portions of the membrane are connected by a bridge portion the top edge between adjacent side walls of the adjacent chamber-defining portions, and the adjacent side walls of the adjacent chamber-defining portions are separated by a gap below the bridge portion.

Possible advantages may include, but are not limited to, one or more of the following. A dual membrane carrier head can be used to apply different pressures to different portions of the substrate, and thereby achieve a desired substrate profile during a polishing operation. For example, variations in the substrate profile can be reduced. This can improve within-wafer uniformity. The inner membrane need not be subject to wear during polishing operations and may need to be replaced much less frequently, if at all. Thus, the inner membrane can be more complex with reduced risk of failure. The inner membrane material need not be as chemically and abrasion resistant as the outer membrane. Thus, the inner membrane can be lower cost.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

In some polishing systems, a membrane in a carrier head is used to apply substantially uniform pressure on a substrate during polishing. However, this substantially uniform pressure cannot effectively address non-uniformity in the polishing process, e.g., due to variations in slurry distribution, or non-uniformity of the substrate prior to polishing.

One solution to address non-uniformity is to have multiple independently pressurizable chambers, where each chamber applies a different pressure to a local region of the substrate. A membrane that provides multiple chambers can be expensive to manufacture, and if such a membrane is in contact with the substrate then there is a danger of the membrane being subject to wear and tearing, thus requiring replacement of an expensive part. However, an outer membrane can be provided over an inner membrane that provides the multiple chambers. The multiple chambers of the inner membrane can be separated by a gap to reduce the "wall effect," or cross-talk through the walls separating the adjacent chambers. As the outer membrane is in contact with the substrate and the inner membrane is not, the outer membrane can be replaced if it wears. The inner membrane need not be subject to wear during polishing operations and may need to be replaced much less frequently, if at all, which can lower costs. Although the outer membrane can be coated with a chemical and abrasion resistant material, the inner membrane need not be coated and thus can be manufactured at lower cost. In addition, the outer membrane is simpler, and thus if the outer membrane does tear, replacement can be at lower cost. On the other hand, inner membrane material need not be as chemically and abrasion resistant as the outer membrane. The inner membrane can be fastened to the carrier head, e.g., to a membrane support, in a more permanent manner, e.g., by an adhesive such as an epoxy. This can reduce leakage from the chambers. Moreover, the inner membrane can be fabricated in a mold with more complex features that aid attachment to the carrier base; because the inner membrane is no longer a consumable this has a lower impact on cost while permitting superior attachment, e.g., reduced leakage.

Figure 1A:
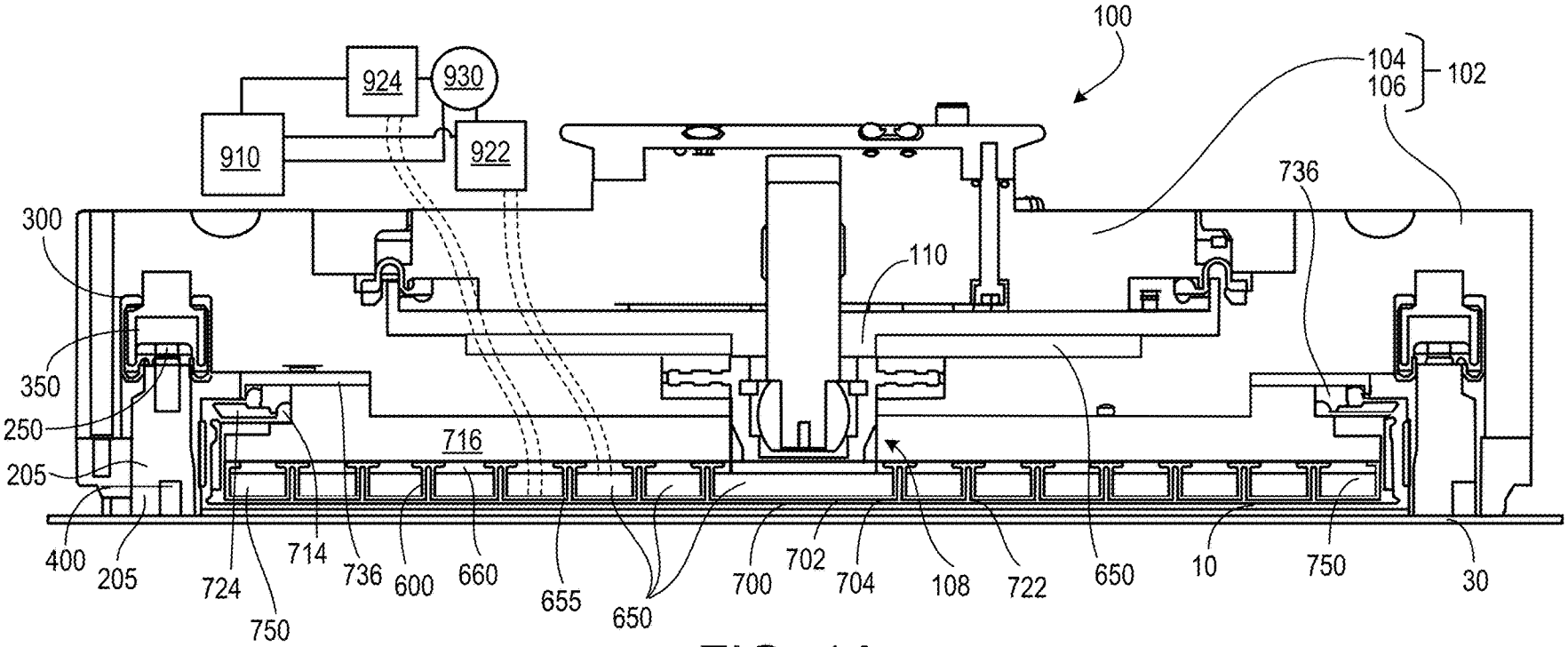
FIG. 1A is a schematic cross-sectional view of a carrier head.
Figure 1B:
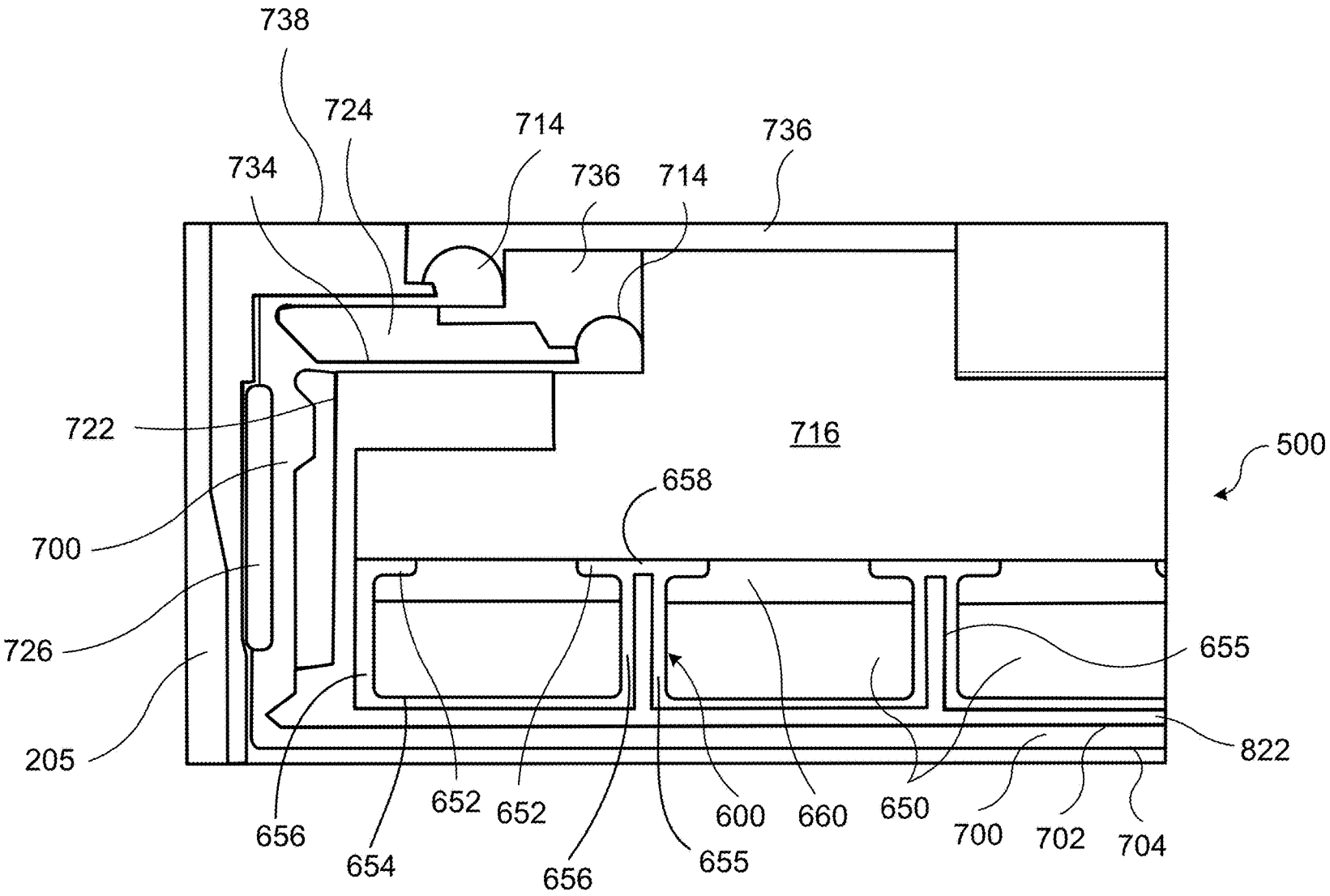
FIG. 1B is a schematic cross-sectional view of a portion of the carrier head in FIG. 1A.
Figure 1C:
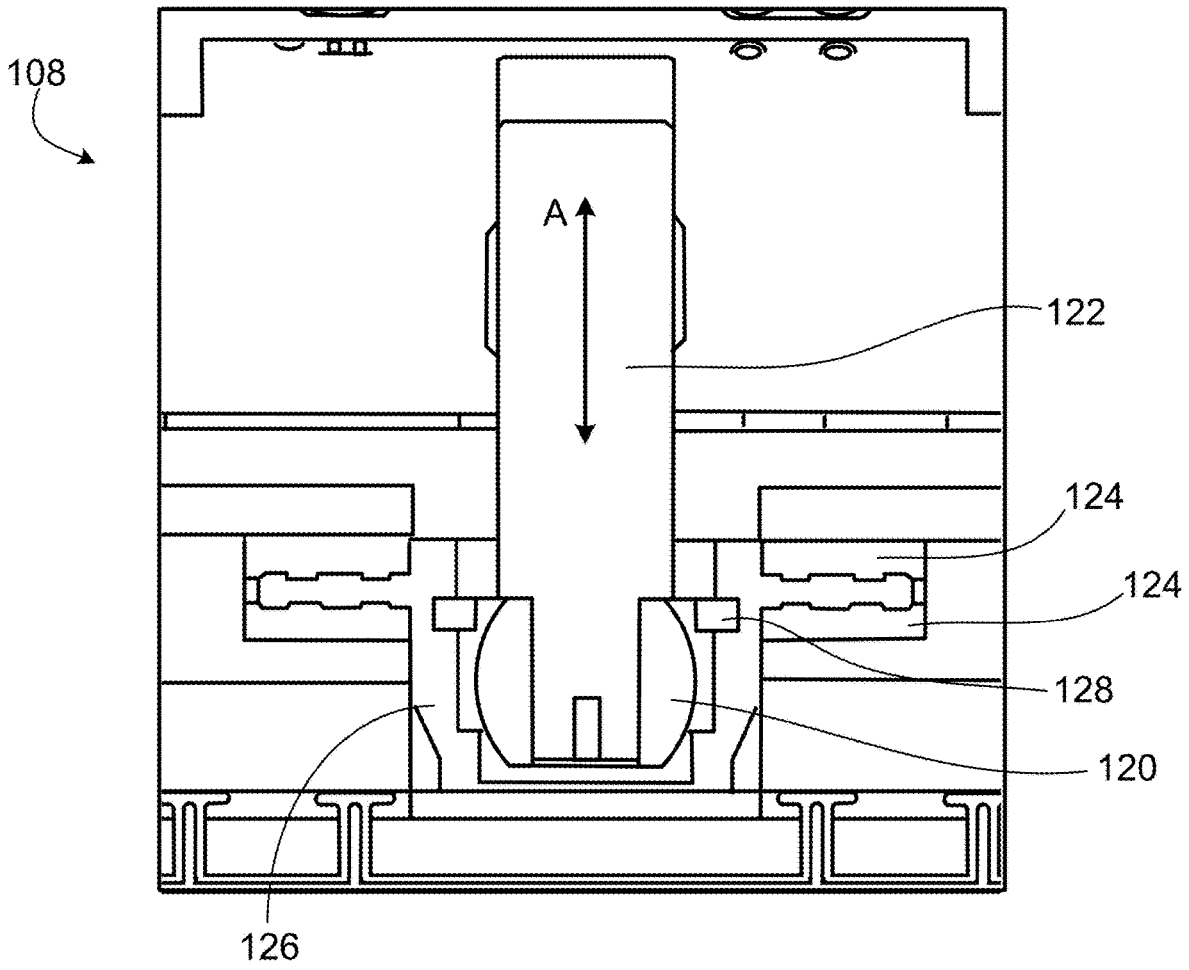
FIG. 1C is a schematic cross-sectional view of a portion of the carrier head in FIG. 1A.

Referring to FIGS. 1A-1C, a substrate 10 can be polished by a chemical mechanical polishing (CMP) apparatus that has a carrier head 100. The carrier head 100 includes a housing 102 with an upper carrier body 104 and lower carrier body 106, a gimbal mechanism 108 (which may be considered part of the lower carrier body 106), a loading chamber 110, a retaining ring assembly (discussed below) connected to the housing 102 (e.g., connected to the upper carrier body 104 and/or the lower carrier body 106), an outer ring 400 connected to the housing 102 (e.g., connected to the upper carrier body 104 and/or the lower carrier body 106), and a membrane assembly 500. In some implementations, the upper carrier body 104 and the lower carrier body 106 are replaced by a single unitary body. In some implementations, there is only a single ring; either the retaining ring 205 or the outer ring 400 is absent.

The upper carrier body 104 can be secured to a rotatable drive shaft to rotate the entire carrier head 100. The upper carrier body 104 can generally be circular in shape. There may be passages extending through the upper carrier body 104 for pneumatic control of the carrier head 100.

The lower carrier body 106 is located beneath the upper carrier body 104, and vertically movable relative to the upper carrier body 104. The loading chamber 110 is located between the upper carrier body 104 and the lower carrier body 106 to apply a load, i.e., a downward pressure or weight, to the lower carrier body 106. The vertical position of the lower carrier body 106 relative to a polishing pad is also controlled by the loading chamber 110. In some embodiments, the vertical position of the lower carrier body 106 relative to the polishing pad is controlled by an actuator.

The gimbal mechanism 108 permits the lower carrier body 106 to gimbal and vertically move relative to the upper carrier body 104 while preventing lateral motion of the lower carrier body 106 relative to the upper carrier body 104.

In some embodiments, the gimbal mechanism 108 has a spherical bearing 120 disposed at the lower end of a shaft 122 that extends into a recess in the housing 102 (see FIG. 1C). The spherical bearing 120 permits the base assembly 104 to rotate about a center of rotation, e.g., the center of the spherical bearing 120. The spherical bearing of the gimbal mechanism 108 can be lubricated to reduce friction, or coated with Teflon. The spherical bearing 120 can be held in a gimbal housing 126 in the base assembly 104 using a locking mechanism 128. For example, the locking mechanism 128 can be a spring-loaded lock that can lock the spherical bearing 120 and the shaft 122 into place in the gimbal housing 126. The gimbal housing 126 can be connected to a remainder of the base assembly 104 using dampeners 124, e.g., a vibration gasket, to reduce the effect of vibration and friction caused by the spherical bearing 120 from transferring to the base assembly 104. However, in some implementations, there is no gimbal.

A substrate 10 can be retained below the membrane assembly 500 by a retaining ring 205. A retaining ring assembly 200 can include the retaining ring 205 and a flexible membrane 300 shaped to provide an annular chamber 350 to control pressure on the retaining ring 205. The retaining ring 205 is positioned beneath the flexible membrane 300 and can be secured to the flexible membrane 300, e.g., by a clamp 250. The load on the retaining ring 205 provides a load to the polishing pad 30. Independent loading on the retaining ring 205 can allow consistent loading on the pad as the ring wears.

While the retaining ring 205 can be configured to retain a substrate 10 and provide active edge process control, the outer ring 400 can provide positioning or referencing of the carrier head to the surface of the polishing pad.

Each chamber in the carrier head can be fluidly coupled by passages through the upper carrier body 104 and the lower carrier body 106 to an associated pressure source (e.g., a pressure source 922), such as a pump or pressure or vacuum line. There can be one or more passages for the annular chamber 350 of the flexible membrane 300, for the loading chamber 110, for the lower pressurizable chamber 722, for the side chamber 724, and for each of the individually pressurizable inner chambers 650. One or more passages from the lower carrier body 106 can be linked to passages in the upper carrier body 104 by flexible tubing that extends inside the loading chamber 110 or outside the carrier head 100. Pressurization of each chamber can be independently controlled. In particular, pressurization of each chamber 650 can be independently controlled. This permits different pressures to be applied to different radial regions of the substrate 10 during polishing, thereby compensating for non-uniform polishing rates.

The membrane assembly 500 can include a membrane support 716, an outer membrane 700, and an inner membrane 600. The membrane support 716 can be a generally disk-shaped body and can be formed of a rigid material, e.g., stainless steel, aluminum, or hard plastic.

The outer membrane 700 has an inner surface 702 that can be positioned to contact the inner membrane 600, and an outer surface 704 that can provide a mounting surface for the substrate 10. The outer membrane 700 can have a perimeter portion 726 that extends upwardly from a circular main portion that provides the mounting surface. The outer membrane 700 can also include two flaps 734, 738 that extend inwardly from the perimeter portion. A first flap 734 of the outer membrane 700 can have a lip 714 secured to the membrane support 716, and can be clamped between the membrane support 716 and a clamp 736. The second flap 734 can similarly have a lip 714 secured to the membrane support 716, e.g., clamped between two clamps 736. The clamps 736 can be secured to the lower carrier body 106 by a fastener, screw, bolt, or other similar fastener. The first flap 734 can separate the lower pressurizable chamber 722 from a side chamber 724 located between the two flaps 734, 738. The lower pressurizable chamber 722 is configured to extend across the bottom of the inner membrane 600 and the sides of the inner membrane 600. The inner membrane 600 is positioned between the lower pressurizable chamber 722 and the membrane support 716.

The outer membrane 700 can apply a downward pressure on a majority or the entirety of the substrate 10. The pressure in the lower pressurizable chamber 722 can be controlled to allow the outer surface 704 of the outer membrane 700 to apply pressure to the substrate 10.

The inner membrane 600 can define a plurality of individually pressurizable inner chambers 650 that can expand vertically relative to one another. For example, each chamber 650 can be defined by a floor portion 654 and two side wall portions 656 of the membrane 600. For each chamber, flange portions 652 can extend inwardly from both side wall portions 656. There can be 2 to 20 individually pressurizable inner chambers 650. For each chamber 650, the flange portions 652 can be captured between a clamp 660 and the membrane support 716, thus securing the membrane 600 to the membrane support 716. The clamps 660 can be secured to the membrane support 716 by a fastener, screw, bolt, or other similar fastener. Alternatively, the flange portions 652 can be secured to the membrane support 716 by an adhesive.

The side walls portions 656 of adjacent chambers can be connected at their top edges by a bridging portion 658, e.g., coplanar with the flange portions 652. In contrast, below the bridging portion 658, the adjacent side wall portions 656 are separated by gap 655. The separate side wall portions 656 below are separated by a clamp 660 of the membrane 600. The side wall portions 656 allow each individually pressurizable inner chamber 650 to vertically expand relative to an adjacent pressurizable chamber 650 with reduced cross-talk.

Each inner chamber 650 can individually apply a downward pressure on a corresponding portion of the inner membrane 600, which can then apply a downward pressure on a corresponding portion of the outer membrane 700, which can then apply downward pressure on a corresponding portion of the substrate 10. Further, the combination of the inner membrane 600 and the outer membrane 700 applying downward forces on the substrate 10 can reduce the effect of the gaps 655 between the inner chambers 650. Without an outer membrane, the portions of the substrate 10 that correspond to gaps between the inner chambers 650 (e.g., the gaps 655) could experience reduced polishing. However, the outer membrane 700 can reduce this effect, as a minimum pressure can be applied by the outer chamber 722 in the gaps, which will thereby smooth over and reduce imperfections caused by gaps between the inner chambers 650.

The bottom surface of the inner membrane 600 and/or the top surface of the outer membrane 700 can be textured, e.g., have increased surface roughness relative to other portions of the membrane or be grooved, to prevent sealing between the inner membrane 600 and the outer membrane 700.

Figure 2A:
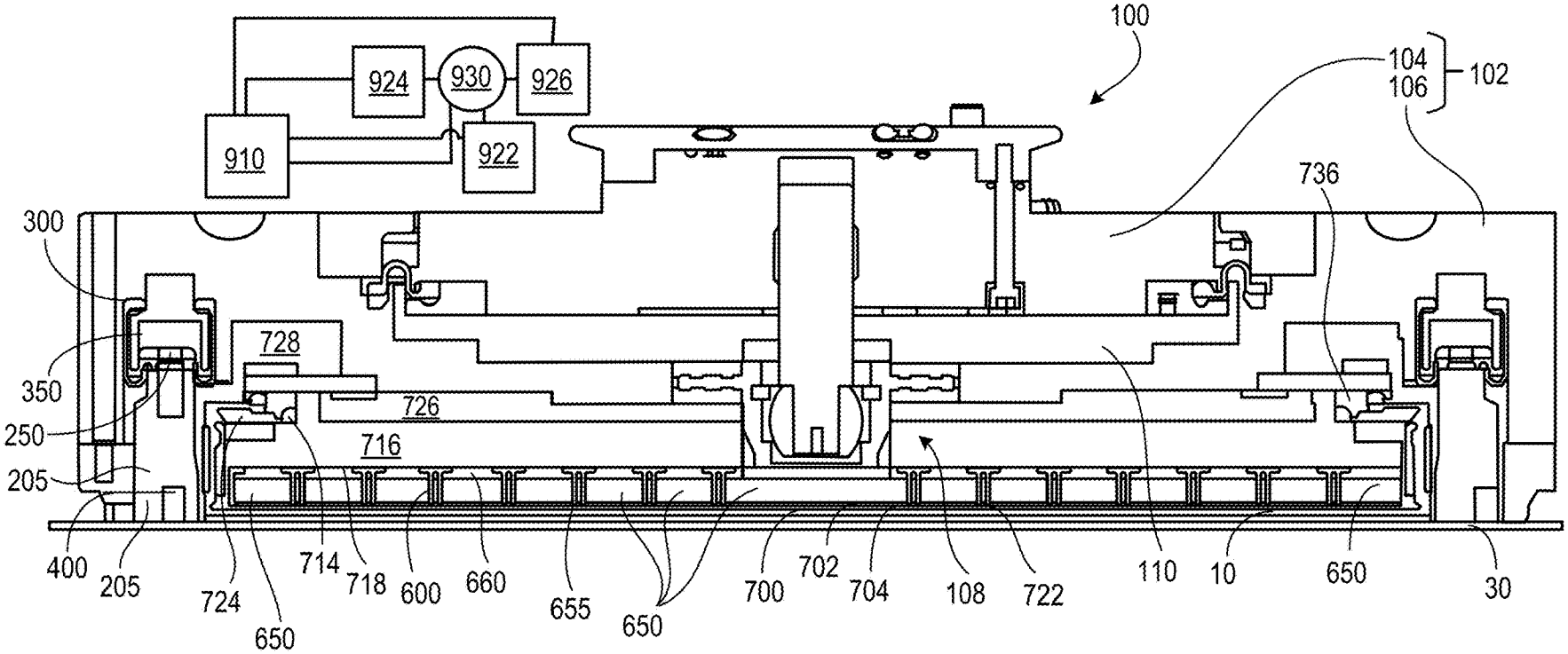
FIG. 2A is a schematic cross-sectional view of another implementation of a carrier head.
Figure 2B:
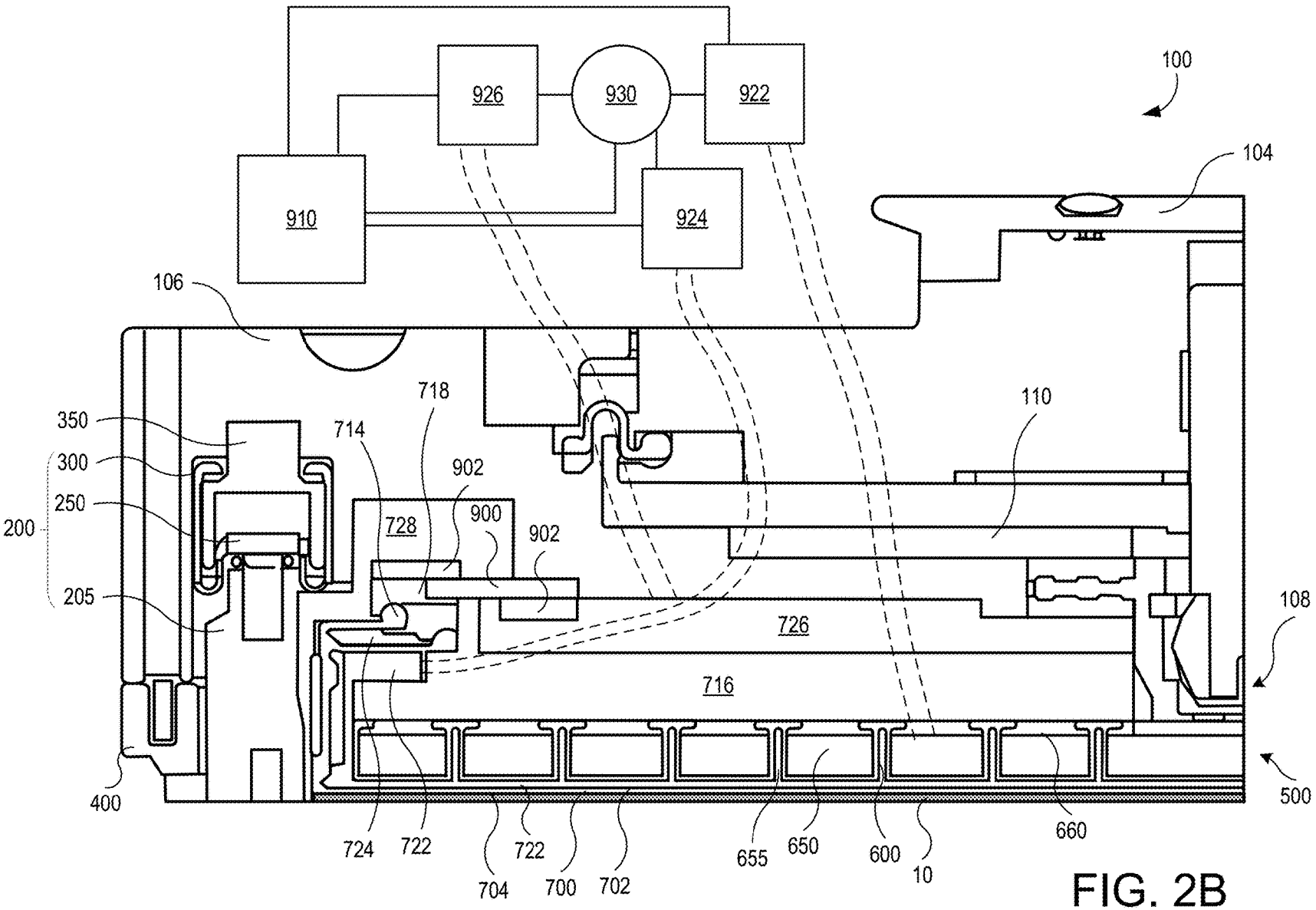
FIG. 2B is a schematic cross-sectional view of a portion of the carrier head in FIG. 2A.
Figure 2C:
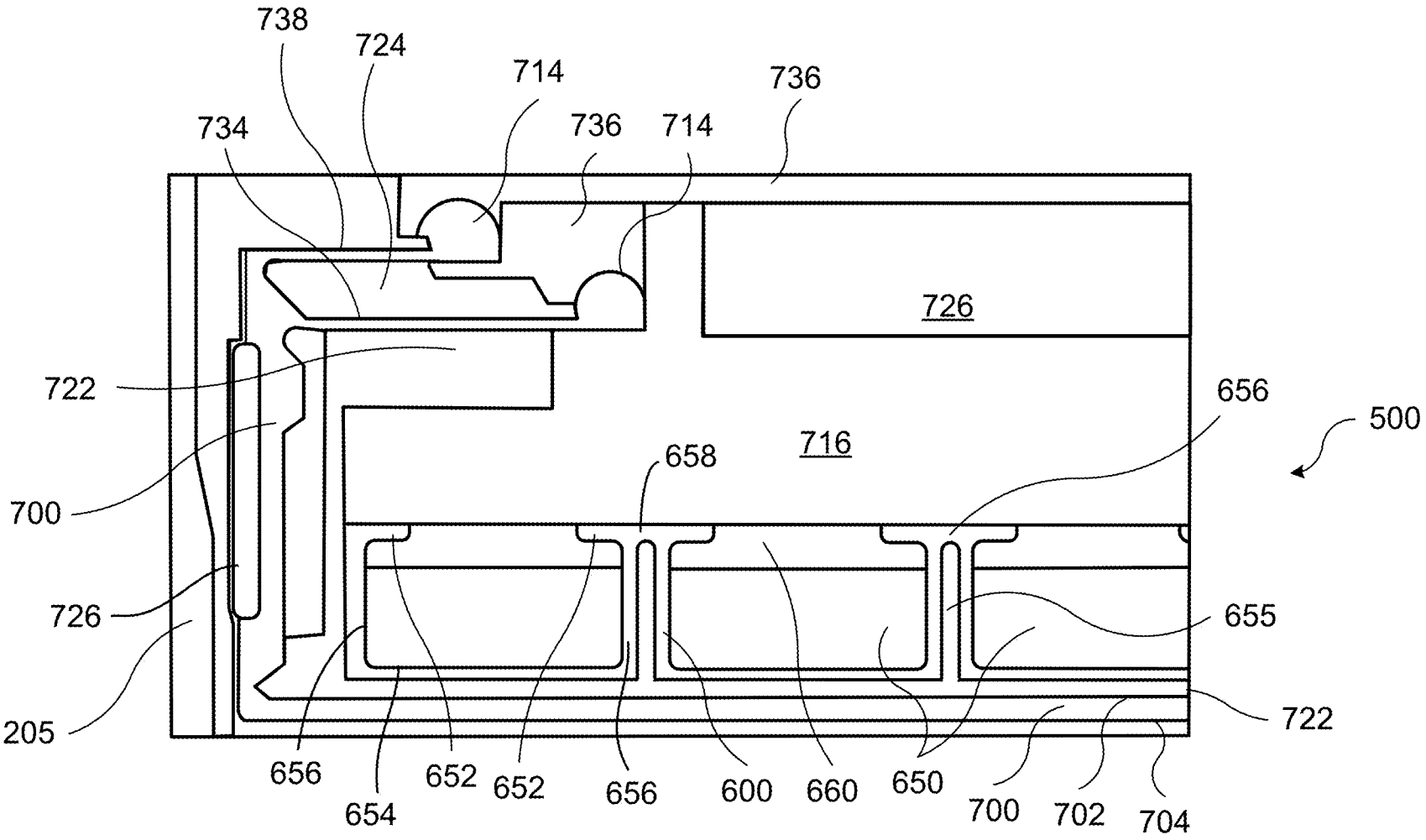
FIG. 2C is a schematic cross-sectional view of a portion of the carrier head in FIG. 2A.

Referring to FIGS. 2A-2C, a carrier head with a floating dual membrane assembly is similar to the carrier head discussed with reference to FIGS. 1A-1C, but the base assembly 102 is movably connected to the membrane assembly 500, e.g., using a flexure 900.

The membrane assembly 500 can include a membrane support 716, an outer membrane 700, and an inner membrane 600. The outer membrane 700 has an inner surface 702 that can be positioned to contact the inner membrane 600, and an outer surface 704 that can provide a mounting surface for the substrate 10. The outer membrane 700 can also include two flaps 734, 738 that extend inwardly from the perimeter portion. A first flap 734 of the outer membrane 700 can have a lip 714 secured to the membrane support 716, and can be clamped between the membrane support 716 and a clamp 736. The second flap 738 can similarly have a lip 714 secured to the membrane support 716, e.g., clamped between two clamps 736. The clamps 736 can be secured to the lower carrier body 106 by a fastener, screw, bolt, or other similar fastener. The first flap 734 can separate the lower pressurizable chamber 722 from a side chamber 724 located between the two flaps 734, 738. The lower pressurizable chamber 722 is configured to extend across the bottom of the inner membrane 600 and the sides of the inner membrane 600. The inner membrane 600 is positioned between the lower pressurizable chamber 722 and the membrane support 716. An upper pressurizable chamber 726 is formed by the membrane assembly 500 (including the membrane support 716) and the lower carrier body 106. The upper pressurizable chamber 726 is sealed from a chamber 728 (which can vent to the outside of the carrier head 100) above the flexure 900 by the flexure 900.

The lower carrier body 106 can be connected to the membrane assembly 500 by the flexure 900. The flexure 900 can be an annular sheet. The flexure 900 can be connected to the housing 102 (e.g., the lower carrier body 106) and the membrane assembly 500 using fasteners 902, e.g., adhesive, screw, bolt, clamp, or by interlocking, to name a few examples. The flexure 900 can be composed of a flexible material such as a silicone rubber or other similar elastomer, or a plastic, metal or composite material such as fiber-reinforced silicone. The flexure 900 can be sufficiently stiff to resist lateral motion so as to keep the membrane assembly 500 centered below the housing 102. However, the flexure 900 can be sufficiently vertically flexible to permit vertical motion of the membrane assembly 500 relative to the carrier body 106.

The flexure 900 can permit the membrane assembly 500 to vertically move relative to the lower carrier body 106 by permitting the flexure 900 to flex, e.g., bendably deflect. As the flexure 900 flexes, the pressure applied by the flexure 900 to the membrane support 716, and thus the substrate 10, can increase or decrease.

Referring to FIGS. 1A and 2A, a controller 910 can be used to regulate the pressure of the various chambers of the carrier head 100. The controller 910 can be coupled to a pressure source 922, a pressure source 924, and a pressure source 926. The pressure sources 922, 924, 926 can be, for example, a pressure chamber, hydraulic chamber, gas chamber, etc. The pressure source 922 can be connected to the individually pressurizable inner chambers 650, and the pressure source 924 can be connected to the outer membrane 700, and the pressure source 926 can be connected to the upper pressurizable chamber 726 (see FIGS. 2A-2C). A sensor 930 can measure the pressure(s) in the pressure sources 922, 924, 926, the individually pressurizable inner chambers 650, the outer membrane 700, and the upper pressurizable chamber 726 (see FIGS. 2A-2C), and can communicate the measured pressure(s) to the controller 910. The controller 910 can cause the pressure sources 922, 924, 926 to increase and/or decrease the pressure in the individually pressurizable inner chambers 650, the outer chamber 722, the lip chamber 724, and/or the upper pressurizable chamber 726.

Figure 3:
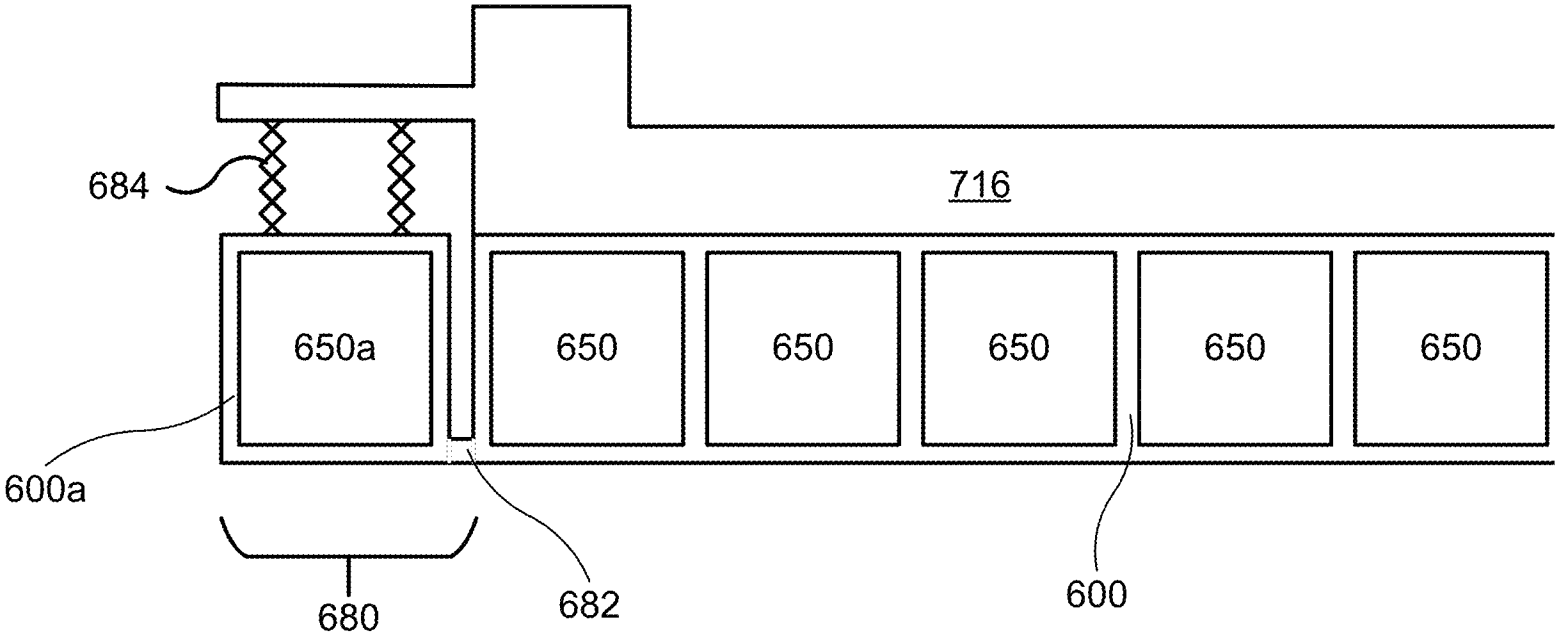
FIG. 3 is a schematic cross-sectional view of an inner membrane with an edge-control zone.

Referring to FIG. 3, in another implementation, the carrier head has separate control over an edge control zone 680. The edge control zone 680 is defined by an individually pressurizable inner chamber 650*a* that is enclosed by a membrane portion 600*a*. The membrane portion 600*a* is flexibly connected to a remainder of the inner membrane 600 with a flexure 682. An actuator, e.g., bellows 684 which can increase or decrease in pressure, can hingedly flex the inner chamber 650*a* to provide focused edge loading. That is, the inner chamber 650*a* can move semi-independently from the inner membrane 600 and the inner chambers 650. An advantage is that the inner chamber 650*a* can perform edge control polishing on the substrate 10 (not illustrated) to improve edge uniformity, e.g., reduce a checkmark profile.

The controller (or "control system") can be implemented in digital electronic circuitry, in tangibly-embodied computer software or firmware, in computer hardware, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus.

This specification uses the term "configured" in connection with the control system. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

A number of embodiments of the invention have been described. Nevertheless, it will be understood that various modifications may be made without departing from the spirit and scope of the invention. For example, although FIG. 1B illustrates the adjacent chambers of inner membrane as having side walls separated by a gap, the adjacent chambers could share a common sidewall. Accordingly, other implementations are within the scope of the following claims.

What is claimed is:

1. A method for chemical mechanical polishing with a carrier head, comprising: holding a substrate in the carrier head that includes a membrane assembly with an outer membrane and an inner membrane that defines a plurality of individually pressurizable annular inner chambers; pressurizing a lower chamber between the inner membrane and the outer membrane to a first pressure; pressurizing at least some of the plurality of individually pressurizable annular inner chambers to a second pressure equal to or greater than the first pressure, wherein each of the annular inner chambers of the plurality of individually pressurizable annular inner chambers is separated from an adjacent annular inner chamber by a gap therebetween, the gap open to the lower chamber such that cross-talk is reduced when pressurizing one individually pressurizable inner chamber that is adjacent another individually pressurizable annular inner chamber; and creating relative motion between the substrate and a polishing pad such that pressure from the lower chamber causes polishing of the substrate at a first rate and pressure of the one or more inner chambers supplementally increases the polishing of the substrate in regions corresponding to the individually pressurizable annular inner chambers.

2. The method of claim 1, wherein there are 2 to 20 individually pressurizable annular inner chambers, and further comprising supplementally increasing the polishing of the substrate in regions corresponding to the 2 to 20 individually pressurizable annular inner chambers.

3. The method of claim 1, wherein the annular inner chambers are concentric.

4. The method of claim 1, comprising measuring a pressure value in some of the individually pressurizable annular inner chambers or in the lower chamber.

5. The method of claim 4, comprising communicating the pressure value to a controller and causing the pressure value to increase or decrease in the individually pressurizable annular inner chambers or in the lower chamber based on a pressure threshold value.

6. The method of claim 5, wherein causing the pressure value to increase or decrease in the individually pressurizable annular inner chambers comprises controlling a pressure source to increase or decrease the pressure in the individually pressurizable annular inner chambers.

* * * * *